US008968169B2

(12) United States Patent
Eiken

(10) Patent No.: US 8,968,169 B2
(45) Date of Patent: Mar. 3, 2015

(54) DECANTER CENTRIFUGE HAVING AN OUTLET OPENING WITH AN INCLINED EDGE

(75) Inventor: Jon Eiken, Zurich (CH)

(73) Assignee: Alfa Laval Corporate AB, Lund (SE)

( * ) Notice: Subject to any disclaimer, the term of this patent is extended or adjusted under 35 U.S.C. 154(b) by 916 days.

(21) Appl. No.: 13/142,549

(22) PCT Filed: Dec. 23, 2009

(86) PCT No.: PCT/IB2009/055926

§ 371 (c)(1),
(2), (4) Date: Sep. 23, 2011

(87) PCT Pub. No.: WO2010/076750

PCT Pub. Date: Jul. 8, 2010

(65) Prior Publication Data

US 2012/0021889 A1 Jan. 26, 2012

(30) Foreign Application Priority Data

Dec. 30, 2008 (DK) ..... 2008 01846

(51) Int. Cl.
*B04B 1/20* (2006.01)
*B04B 11/02* (2006.01)

(52) U.S. Cl.
CPC ..... *B04B 1/20* (2013.01); *B04B 2001/2075* (2013.01); *B04B 2001/2083* (2013.01)
USPC ..... 494/53; 494/57

(58) Field of Classification Search
USPC ..... 494/53, 54, 56, 57, 60; 210/380.1, 210/380.3
See application file for complete search history.

(56) References Cited

U.S. PATENT DOCUMENTS

| | | | | | |
|---|---|---|---|---|---|
| 3,580,492 | A | * | 5/1971 | Schnittger et al. | 494/53 |
| 4,334,647 | A | | 6/1982 | Taylor | |
| 4,556,873 | A | | 12/1985 | Yamada et al. | |
| 4,575,370 | A | * | 3/1986 | LaMontagne | 494/56 |
| 4,764,163 | A | * | 8/1988 | Caldwell | 494/56 |
| 4,950,219 | A | * | 8/1990 | Luchetta | 494/53 |
| 5,217,428 | A | * | 6/1993 | Schlip et al. | 494/56 |
| 5,653,674 | A | | 8/1997 | Leung | |

(Continued)

FOREIGN PATENT DOCUMENTS

| | | | |
|---|---|---|---|
| CN | 200982796 | Y | 11/2007 |
| DE | 10021642 | A1 | 11/2001 |

(Continued)

OTHER PUBLICATIONS

International Search Report; International Application No. PCT/IB2009/055926, Date Mailed May 12, 2010.

*Primary Examiner* — Charles Cooley
(74) *Attorney, Agent, or Firm* — MKG, LLC

(57) ABSTRACT

The invention is a decanter centrifuge for separating a first substance and a second substance with different densities, comprising a bowl rotating in use around a horizontal axis of rotation in a direction of rotation, said axis of rotation extending in a longitudinal direction of said bowl, a radial direction extending perpendicular to the longitudinal direction, a base plate provided at one longitudinal end of said bowl, said base plate having an internal side and an external side, an outlet opening provided in said base plate for discharge of one of said substances. A slide valve body is adapted for covering an adjustable part of the outlet opening to delimit an effective area of the outlet opening.

21 Claims, 5 Drawing Sheets

(56) References Cited

U.S. PATENT DOCUMENTS

| | | | | |
|---|---|---|---|---|
| 5,685,819 | A | 11/1997 | Nishida et al. | |
| 5,948,271 | A | 9/1999 | Wardwell et al. | |
| 8,845,506 | B2 * | 9/2014 | Walraven et al. | 494/56 |
| 2004/0072667 | A1 | 4/2004 | Leung et al. | |
| 2011/0143906 | A1 * | 6/2011 | Geehan et al. | 494/56 |
| 2012/0021889 | A1 * | 1/2012 | Eiken | 494/52 |
| 2012/0028782 | A1 * | 2/2012 | Eiken | 494/2 |
| 2014/0235423 | A1 * | 8/2014 | Pasol et al. | 494/56 |
| 2014/0274651 | A1 * | 9/2014 | Geehan et al. | 494/37 |

FOREIGN PATENT DOCUMENTS

| | | | | |
|---|---|---|---|---|
| EP | 1588769 | A1 * | 10/2005 | B04B 11/02 |
| GB | 2233258 | A | 9/1991 | |
| JP | 11179236 | A | 6/1999 | |
| JP | 11-197547 | A | 7/1999 | |
| JP | 11-197548 | A | 7/1999 | |
| WO | 9427726 | A1 | 12/1994 | |
| WO | 2008138345 | A1 | 11/2008 | |

* cited by examiner

DECANTER CENTRIFUGE HAVING AN OUTLET OPENING WITH AN INCLINED EDGE

The present invention relates to a decanter centrifuge for separating a first substance and a second substance with different densities. The decanter centrifuge comprising includes a bowl rotatable around a horizontal axis of rotation in a direction of rotation. The axis of rotation extending extends in a longitudinal direction of the bowl. A radial direction extends perpendicular to the longitudinal direction. A base plate is provided at one longitudinal end of the bowl. The base plate has an internal side and an external side, and an outlet opening is provided in the base plate for discharge of one of the substances. The outlet opening extends through a first angular interval relative to the axis of rotation. The decanter centrifuge includes a slide valve body adapted for covering an adjustable part of the outlet opening to delimit an effective area of the outlet opening. The outlet opening includes an edge that is inclined.

BACKGROUND

A decanter centrifuge generally has fixed weir edges and thus a fixed level of the one substance to be discharged (in the following liquid, which is normally the case) in the bowl of the decanter centrifuge. The position of the weir edge is generally determined either by the radial position of the outlet opening in the base plate of the decanter centrifuge, or by the position in which an external weir edge is mounted fixedly on the base plate of the decanter centrifuge, generally such that it covers a part of the outlet opening. Such a decanter centrifuge is e.g. known from JP 11-179236.

Thus the liquid level in the bowl of a known decanter centrifuge is normally determined by the position of the weir edge and cannot be changed, except by unduly complex procedures.

It is one object of the present invention to provide a decanter centrifuge that eliminates or reduces the problem mentioned above.

SUMMARY OF THE INVENTION

According to a first aspect of the invention this object is achieved by providing a decanter centrifuge of the art mentioned in the first paragraph where the slide valve body includes a first edge extending in the radial direction. The edge delimits the effective area of the outlet opening when the slide valve body is in a position covering an adjustable part of said outlet opening. The outlet opening is radially away from the axis of rotation and is delimited by a second edge. The second edge has in at least a major part of the first angular interval in a radial plane perpendicular to the axis of rotation an inclination relative to the radial direction of at least 60°, preferably at least 70°, more preferably at least 75°, said second edge constituting a weir edge.

Thereby it becomes possible to adjust the effective area of the outlet opening that is covered and thereby to adjust the liquid level in the bowl of the decanter centrifuge, and a simple but effectively working slide valve body for adjusting the liquid level in the bowl of the decanter centrifuge is provided for.

According to a preferred embodiment of the invention said slide valve body is provided for rotation around the axis of rotation, thereby providing for a decanter centrifuge with a slide valve body being particularly simple to adjust.

According to a preferred embodiment of the invention the decanter centrifuge comprises a level sensor in the bowl, thereby providing for the possibility of measuring the liquid level within the bowl at any time before, during or after operation and regardless of the construction of weir edges and/or devices provided for energy recovery purposes.

According to a preferred embodiment of the invention the slide valve body is provided adjacent the plate at the internal side of the base plate, thereby providing for a particularly well functioning and easy to operate slide valve body and thus the decanter centrifuge.

According to an embodiment of the invention the slide valve body comprises an edge extending in a direction, which with respect to a circumferential direction comprises an inclination of less than 30°, said edge constituting an adjustable weir edge when said slide valve body is in a position covering an adjustable part of said outlet opening.

According to a preferred embodiment of the invention the decanter centrifuge comprises a wall projecting from said external side of said base plate for guiding the substance discharged from said outlet opening in a direction opposite the direction of rotation of the bowl to recover kinetic energy from the substance, thereby combining the above advantages with the benefits of energy recovery.

According to a further embodiment of the invention the decanter centrifuge, the wall is extending from the vicinity of the outlet opening towards a rim of the base plate, said wall extending through a second angular interval adjacent the first angular interval, said second angular interval being at least 30°, preferably at least 45°, more preferably at least 60°, and said wall having in a radial plane perpendicular to the axis of rotation an inclination relative to the radial direction of at least 60°, preferably at least 70°, more preferably at least 75°, and the outlet opening is radially away from the axis of rotation delimited by a second edge, the wall and the second edge having in at least a major part of the first angular interval in a radial plane perpendicular to the axis of rotation an inclination relative to the radial direction of at least 60°, preferably at least 70°, more preferably at least 75°, said second edge constituting a weir edge when said outlet opening is uncovered. In this way a decanter centrifuge combining the above advantages with a particularly advantageous energy recovering structure is provided.

According to a preferred embodiment of the invention the outlet opening is delimited by a circumferential edge comprising three parts, a first part constituting the second edge and having relative to the axis of rotation a proximal end and a distal end, a second part extending from the distal end of the first part towards the axis of rotation and a third part connecting the first part and the second part, the slide valve body comprises an opening delimited by a circumferential edge comprising three sections, a first section extending in a direction, which with respect to a circumferential direction comprises an inclination of less than 30°, preferably less than 20°, more preferably less than 15°, said first section having relative to the axis of rotation a proximal end and a distal end, a second section extending from the distal end of the first edge towards the axis of rotation and a third section connecting the first section and the second section, and the slide valve body is provided for rotation around the axis of rotation. Thereby is provided for a decanter centrifuge by which the abovementioned advantages are obtained in a particularly simple way.

According to a preferred embodiment of the invention the decanter centrifuge comprises a stop means adapted for delimiting the rotation around the axis of rotation of said slide valve body.

Such a stop means provides for a slide valve body that may be limited in rotation to cover a desired range of positions and that may provide for a marking of extreme positions of the slide valve body, e.g. fully closed and fully opened opening. Also, such a stop may provide for elimination of any possible disadvantages connected with positions outside the chosen range. For instance a stop may provide for avoiding rotating the slide valve body to far. For instance when desiring fully open outlet openings rotating the slide valve body too far may result in inadvertently still covering part of the outlet opening.

According to a preferred embodiment of the invention the base plate comprises a plurality of, preferably three, outlet openings, and said slide valve body comprises a plurality of, preferably three, corresponding openings, thereby providing for the possibility of adjusting the liquid level at more than one outlet opening simultaneously.

According to a preferred embodiment of the invention the decanter centrifuge comprises a drive for sliding, especially rotating, the slide valve body, thereby providing for automatic and continuous adjustment of the liquid level in the bowl and/or of the weir edge, even during operation of the decanter centrifuge.

According to a preferred embodiment of the invention the slide valve body is a one piece body, thereby providing for simultaneous adjustment of the liquid level in the bowl and/or of the weir edge with respect to several outlet openings.

DESCRIPTION OF THE DRAWINGS

The invention will now be described in further detail based on a non-limiting exemplary embodiment, and with reference to the drawings. In the drawings.

DETAILED DESCRIPTION OF THE INVENTION

Figure 1:
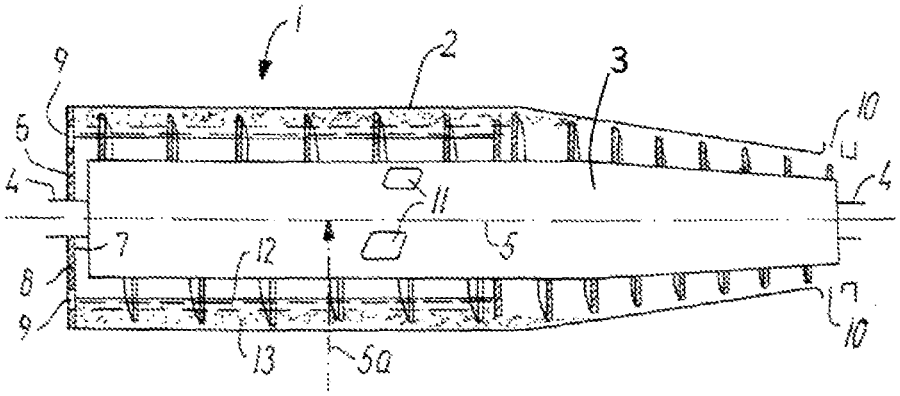
FIG.1 PRIOR ART
FIG. 1 shows a schematic view of an embodiment of a decanter centrifuge of prior art.

FIG. 1 shows a prior art decanter centrifuge 1 comprising a bowl 2 and a screw conveyor 3 which are mounted on a shaft 4 such that they in use can be brought to rotate around an axis 5 of rotation, the axis 5 of rotation extending in a longitudinal direction of the bowl 2. Further, the decanter centrifuge 1 has a radial direction 5*a* extending perpendicular to the longitudinal direction.

For the sake of simplicity directions "up" and "down" are used herein as referring to a radial direction towards the axis 5 of rotation and away from the axis 5 of rotation, respectively.

The bowl 2 comprises a base plate 6 provided at one longitudinal end of the bowl 2, which base plate 6 has an internal side 7 and an external side 8. The base plate 6 is provided with a number of liquid phase outlet openings 9. Furthermore the bowl 2 is at an end opposite to the base plate 6 provided with solid phase discharge openings 10.

Further the screw conveyor 3 comprises inlet openings 11 for feeding e.g. a slurry to the decanter centrifuge 1, the slurry comprising a light or liquid phase 12 and a heavy or solid phase 13. During rotation of the decanter centrifuge 1 as previously described, separation of the liquid 12 and solid 13 phases is obtained. The liquid phase 12 is discharged through the outlet openings 9 in the base plate 6, while the screw conveyor 3 transports the solid phase 13 towards the solid phase discharge openings 10 through which the solid phase 13 is eventually discharged.

Figure 2:
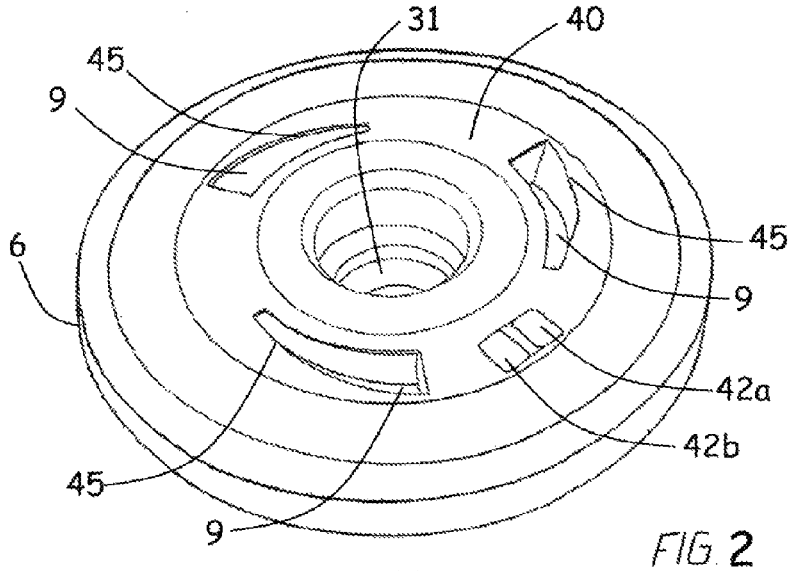
FIG. 2 shows a bottom view of a base plate of a decanter centrifuge according to a first embodiment of the invention featuring a slide valve body.

FIG. 2 shows a base plate 6 of a decanter centrifuge 1 according to a first embodiment of the invention seen from its internal side, i.e. from the side facing the internal of the decanter centrifuge 1 when the base plate 6 is mounted. The base plate 6 of FIG. 2 has three outlet openings 9. However, the exact number of outlet openings may be fewer or more than the three shown. Each outlet opening 9 is delimited by a circumferential edge comprising three parts 22, 23, 24 (cf. FIG. 3). A first part constitutes a weir edge 22, a second part 23 extends between a first angular interval 25 (cf. FIG. 5) and a second angular interval 26 from the weir edge 22 towards the axis of rotation 5 at one end of the weir edge 22 and a third part 24 connects the first part 22 and the second part 23. The second part 23 is generally L-shaped comprising a small leg 46.

The weir edge 22 is radially away from the axis of rotation 5 forming a delimitation of the outlet opening 9, the weir edge 22 extending through the first angular interval 25 and having in the first angular interval 25 in a radial plane perpendicular to the axis of rotation 5 an inclination relative to the radial direction of about 82°. However, the said inclination of the weir edge 22 may in other embodiments take other smaller or larger values.

On the base plate 6 is provided a slide valve body 40 in one piece comprising three openings 45 corresponding in shape and orientation to the outlet openings 9. Alternatively there may be provided a separate slide valve body for each outlet opening in the base plate 6.

The slide valve body is in FIG. 2 shown in its open position, the outlet openings 9 being completely free. The slide valve body 40 is mounted such as to be able to rotate around the axis of rotation. Furthermore the slide valve body 40 may comprise adjustment means (not shown) for sliding or rotating the slide valve body 40. Such adjustment means is preferably a suitable drive means, but a manual adjustment means is also foreseen.

Furthermore, the slide valve body 40 comprises a level sensor comprising two sensor elements 42*a*, 42*b*. In this embodiment the sensor elements 42*a*, 42*b* are RFID sensor elements, and are adapted for monitoring (i.e. measuring and communicating to an external device or the above mentioned adjustment means) the liquid level in the bowl 2 of the decanter centrifuge 1. Such sensor elements are in principle capacitive elements sensing a change of the liquid level by a change in the dielectric value between the capacitor plates. The sensor elements 42*a*, 42*b* are connected to a coil 43 that is concentric with the axis of rotation 5 (FIG. 3) providing a resonance circuit. The change in dielectric value between the capacitor plates of the sensor elements 42*a*, 42*b* causes a change in resonance frequency. The resonance frequency can be picked up by an external sensor, which also regularly will excite the resonance circuit. In this way the liquid level in the bowl 2 may be monitored during operation of the decanter centrifuge 1, and the slide valve body 40, if comprising a drive means as described above, may instantly be rotated in response to the liquid level measurement.

In the embodiment shown, the slide valve body 40 is provided on the internal side of the base plate 6. However, the slide valve body 40 may in principle also be mounted on the external side, i.e. opposite the internal side, of the base plate, e.g. between the base plate and an external liquid phase discharge member mounted on the base plate 6 for the purpose of energy recovery. In case the slide valve body 40 is mounted on the external side of the base plate 6 it is, however, preferable if the sensor elements 42*a*, 42*b* are still mounted internally in the bowl 2 of the decanter centrifuge 1 to ensure correct measurement of the liquid level.

Figure 3:
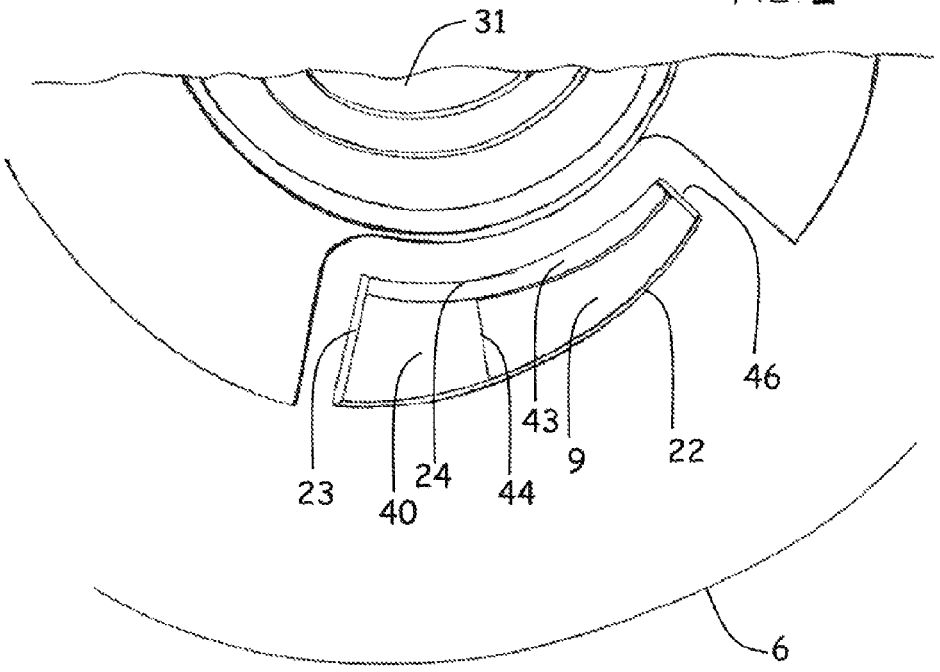
FIG. 3 shows a sectional end view of the base plate of a decanter centrifuge according to FIG. 2 showing one discharge opening with the slide valve body in a partially closed position.

FIG. 3 shows a close up of a section of a base plate 6 seen from the end in the longitudinal direction. As can be seen the slide valve body 40 has been rotated counter clockwise from a neutral position shown in FIG. 2, such that it partially covers the outlet opening 9. The liquid discharged through the outlet opening is thus forced out where the radius of the outlet opening is smaller, the edge 44, which extends radially, of the slide valve body 40 thus determining the liquid level in the bowl. The outlet opening 9 may even be closed by means of the slide valve body 40.

Since the size and shape of the openings 45 of the slide valve body 40 are substantially identical to the size and shape of the outlet openings 9, the openings 45 of the slide valve body 40 comprise edges parallel to the weir edges 22 of the outlet openings 9. Rotating the slide valve body 40 from the neutral position in the opposite direction compared to the situation in FIG. 3, i.e. rotating the slide valve body 40 clockwise as seen from the external side as in FIG. 3, the edges parallel to the weir edges 22 will emerge from behind the weir edges and delimit the open areas of the outlet openings 9, thus effectively raising the weir edge to a smaller radial position thereby raising the level of liquid inside the bowl 2.

Figure 4:
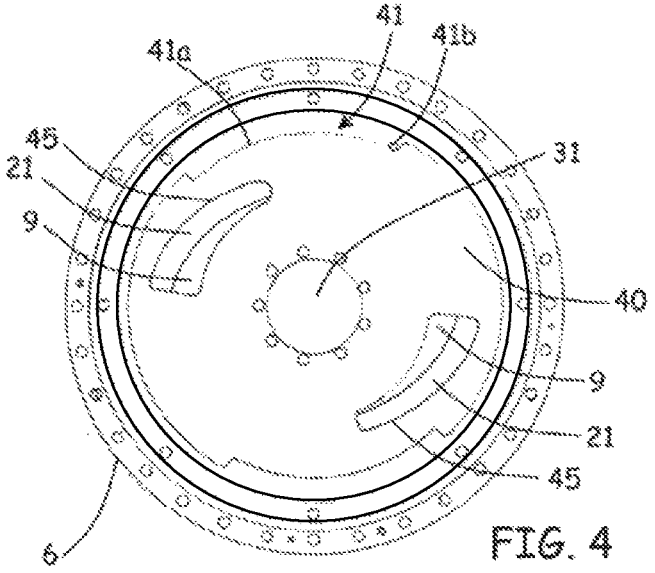
FIG. 4 shows a bottom view of a base plate of a decanter centrifuge according to a second embodiment of the invention featuring a slide valve body.

FIG. 4 shows the internal side of a second embodiment of a base plate 6 comprising a slide valve body 40 according to the invention. In this embodiment, the slide valve body comprises two openings corresponding in shape to the two outlet openings 9 of the base plate 6. Furthermore, the slide valve body 40 is provided with a stop mechanism 41 for limiting the angular interval through which the slide valve body 40 may be rotated. In the embodiment shown the stop mechanism 41 comprises an incision 41*a* extending along the periphery of the slide valve body 40 and determining the angular interval of the rotation and a pin 41*b* or the like blocking the rotation of the slide valve body 40 when it abuts the incision 41*a* as shown on FIG. 4.

Figure 5:
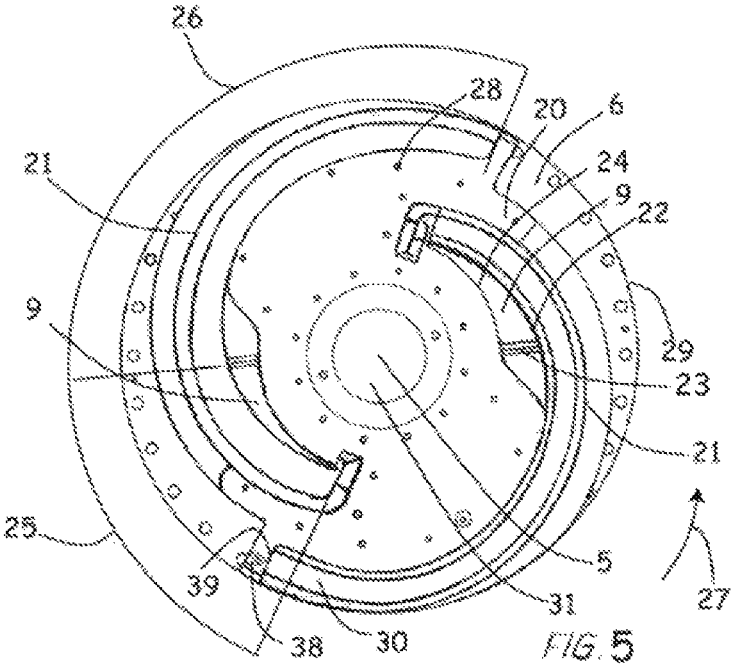
FIG. 5 shows an end view of the base plate of a decanter centrifuge according to the second embodiment of the invention, the base plate being provided with two walls.

FIG. 5 shows the external side of the second embodiment of the base plate 6. The base plate 6 is equipped with a decanter centrifuge discharge member 20 in a first embodiment mounted on the base plate such that the axis of rotation 5 extends through a central opening 31. The decanter centrifuge discharge member 20 may be mounted using screws or the like inserted through first holes 28. Alternatively, the decanter centrifuge discharge member 20 may be mounted on a decanter centrifuge discharge member base plate (not shown) similar to the base plate 6 shown in FIG. 5 that may then be mounted on the base plate 6 of the decanter centrifuge 1. For mounting the decanter centrifuge discharge member base plate there may be provided holes such as second holes 36. However, in the embodiment shown the second holes 36 are used to mount the base plate 6 on the decanter centrifuge 1. As another alternative the decanter centrifuge discharge member may simply be cast or moulded in one piece with the base plate 6 of the decanter centrifuge.

The decanter centrifuge discharge member 20 and the base plate 6 comprise a plurality of outlet openings 9. In the embodiment shown in FIG. 2 there is two such outlet openings 9. Normally such a plurality of outlet openings are provided in the base plate placed equidistantly on a common radius.

As previously mentioned, each outlet opening 9 is delimited by a circumferential edge comprising three parts 22, 23, 24. The third part 24 extends in the embodiment shown along a drawing of a circle on the base plate 6.

The weir edge 22 is radially away from the axis of rotation 5 forming a delimitation of the outlet opening 9, the weir edge 22 extending through the first angular interval 25 and having in the first angular interval 25 in a radial plane perpendicular to the axis of rotation 5 an inclination relative to the radial direction of about 82°, the first angular interval 25 having an extension of about 60 to 65°. It is noted that in this embodiment the general shape of the outlet opening 9 remains uncritical as long as the weir edge 22 is provided in the first angular interval 25 in a radial plane perpendicular to the axis of rotation 5 with an inclination relative to the radial direction preferably being at least 60°.

Furthermore the decanter centrifuge discharge member 20 comprises adjacent each outlet opening 9 a wall 21 extending in a direction opposite to the direction of rotation denoted by an arrow 27 through the first angular interval 25 along the weir edge 22 with substantially the same inclination relative to the radial direction as the weir edge 22. The transition from weir edge 22 to wall 21 is preferably substantially smooth.

The wall 21 further extends through the second angular interval 26 towards the rim 29 of the base plate 6 with an inclination relative to the radial direction increasing towards the rim 29. In the embodiments shown the wall 21 has a total angular extension of approximately 180°, thus ending adjacent the rim 29 at the far end 39 of the wall 21 opposite the outlet opening 9. At the rim 29, the inclination of the wall 21 relative to the radial direction has increased from the initial about 82° to about 88° to 90°. Both the angular extension and inclination relative to the radial direction of the wall 21 and the weir edge 22 of the outlet opening 9 may take other values than stated above. However, as a rule of thumb the longer the angular extension of the wall 21 the more efficient the energy recovery obtained. Preferably the angular extension of the wall 21 through the second angular interval 26 is at least 30°.

The wall 21 further comprises a raised part 30, whereby the wall 21 is provided with the shape of an open channel, as will be described in detail below.

At the far end 39 of the wall 21 the decanter centrifuge discharge member 20 comprises a discharge area 38, the liquid phase leaving the wall over the discharge area 38 in a direction substantially opposite the direction of rotation denoted by arrow 27.

Figure 6:
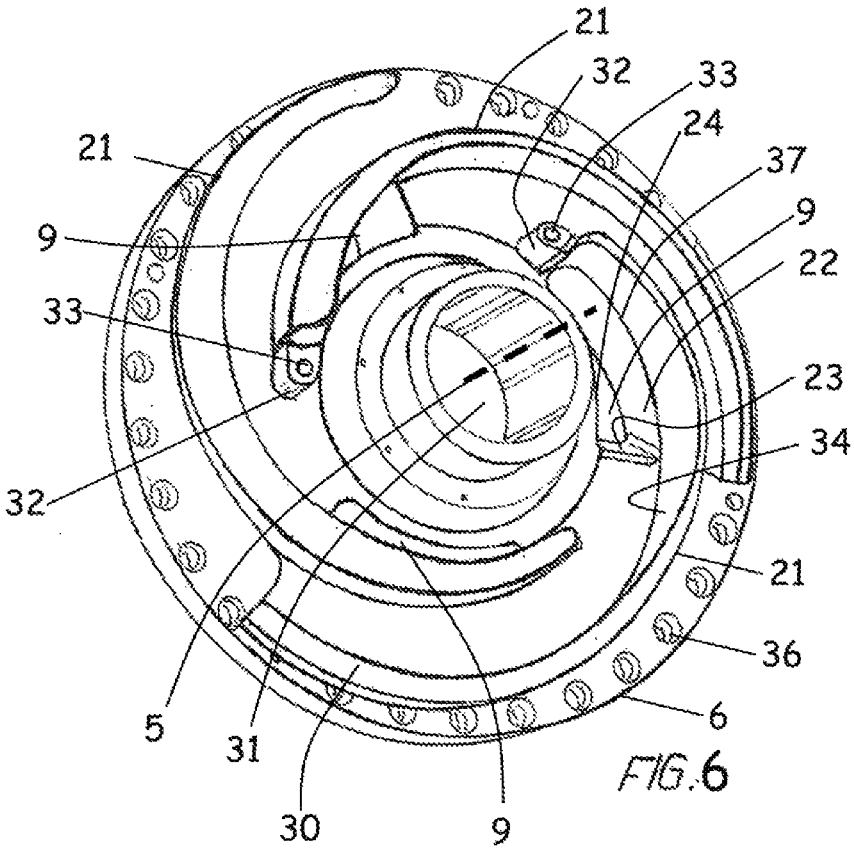
FIG. 6 shows a perspective view of the base plate of a decanter centrifuge according to a third embodiment of the invention, the base plate being provided with three walls.

FIG. 6 shows an end view of a base plate 6 according to the first embodiment as shown in FIG. 2 equipped with a decanter centrifuge discharge member 20 in a second embodiment mounted on the base plate. In this embodiment the decanter centrifuge discharge member 20 comprises three outlet openings 9 each with an adjacent wall 21. Both outlet openings 9 and walls 21 are substantially of the type described above in connection with FIG. 5. In this embodiment the decanter centrifuge discharge member 20 is mounted on the base plate 6 by inserting screws or the like through bushings 33 provided in extensions 32 of each wall 21.

The perspective view of FIG. 6 reveals in more detail that the raised part 30 of the wall 21 provided opposite the base plate 6 serves to provide an open channel 34 for guiding the substance discharged.

Furthermore, it can be seen that the second part 23 of the circumferential edge of the outlet opening 9 may be provided with an inclination with respect to a direction parallel with the axis of rotation 5 and pointing in a direction opposite the direction of rotation (arrow 27). A transition 37 from the outlet opening 9 to the wall 21 is preferably flush to provide a smooth, lossless flow from the outlet 9 onto the wall 21, but a small step to a larger radial distance from the axis of rotation may be present in the transition 37 from the outlet 9 to the wall 21.

Figure 7:
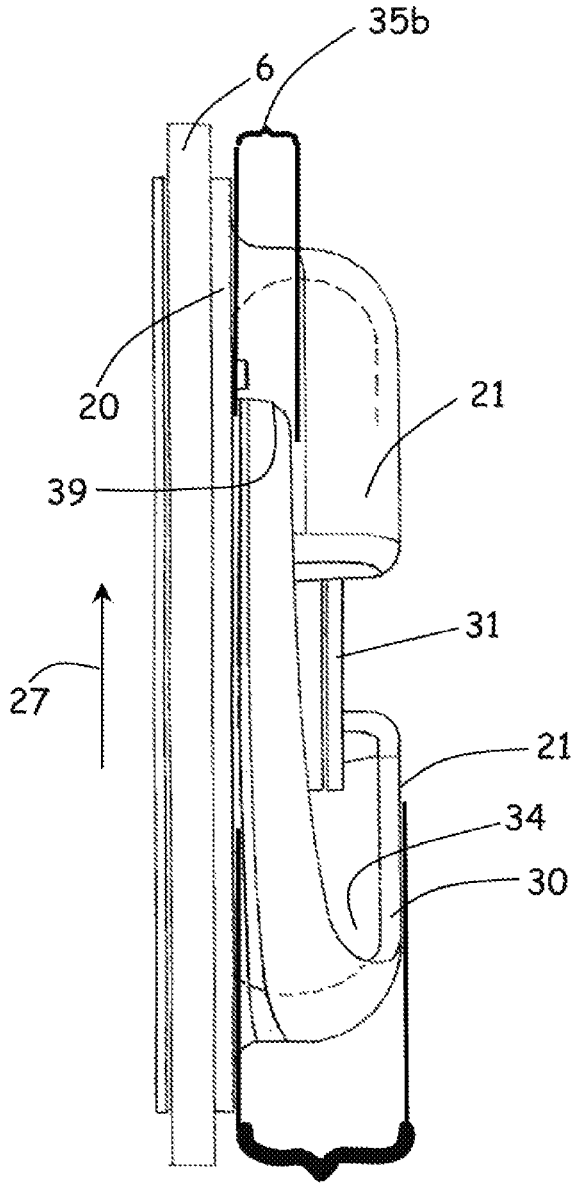
FIG. 7 shows a side view of the base plate of the decanter centrifuge according to FIG. 5.

Turning to FIG. 7, a side view of the base plate 6 according to FIG. 5 with decanter centrifuge discharge member 20 is shown. From FIG. 7 the course of the wall 21, and in particular of the raised part 30 of the wall 21, becomes clearer. As mentioned, the raised part 30 provides an open channel 34, the curvature of which is marked with a dashed line on FIG. 7. As can be seen the width of the channel decreases through the second angular interval 26 in a direction opposite the direction of rotation (arrow 27) such that it has its largest width 35*a* between the first angular interval 25 and the second angular interval 26 and its smallest width 35*b* at its far end 39.

It should be noted that the above description of preferred embodiments is merely an example, and that the skilled person would know that numerous variations are possible without departing from the scope of the claims.

What is claimed is:

1. A decanter centrifuge for separating a first substance and a second substance with different densities comprising:

a bowl rotating in use around a horizontal axis of rotation in a direction of rotation, said axis of rotation extending in a longitudinal direction of said bowl;

a radial direction extending perpendicular to the longitudinal direction;

a base plate provided at one longitudinal end of said bowl, said base plate having an internal side and an external side, an outlet opening provided in said base plate for discharge of one of said substances, said outlet opening extending through a first angular interval relative to the axis of rotation, a slide valve body adapted for covering an adjustable part of the outlet opening to delimit an effective area of the outlet opening, wherein said slide valve body comprises a first edge extending in the radial direction, said edge delimiting the effective area of the outlet opening when said slide valve body is in a position covering an adjustable part of said outlet opening, and in that the outlet opening is radially away from the axis of rotation delimited by a second edge, said second edge having in at least a major part of the first angular interval in a radial plane perpendicular to the axis of rotation an inclination relative to the radial direction of at least 60° said second edge constituting a weir edge.

2. A decanter centrifuge according to claim 1, wherein said slide valve body is provided for rotation around the axis of rotation.

3. A decanter centrifuge according to claim 1, wherein the decanter centrifuge comprises a level sensor in the bowl.

4. A decanter centrifuge according to claim 1, wherein said slide valve body is provided adjacent said base plate at the internal side of said base plate.

5. A decanter centrifuge according to claim 1, wherein said slide valve body comprises an edge extending in a direction, which with respect to a circumferential direction comprises an inclination of less than 30°, said edge constituting an adjustable weir edge when said slide valve body is in a position covering an adjustable part of said outlet opening.

6. A decanter centrifuge according to claim 1, wherein the decanter centrifuge comprises a wall projecting from said external side of said base plate for guiding the substance discharged from said outlet opening in a direction opposite the direction of rotation of the bowl to recover kinetic energy from the substance.

7. A decanter centrifuge according to claim 6, wherein said wall is extending from the vicinity of the outlet opening towards a rim of the base plate, said wall extending through a second angular interval adjacent the first angular interval, said second angular interval being at least 30° and said wall having in a radial plane perpendicular to the axis of rotation an inclination relative to the radial direction of at least 60° and wherein the outlet opening is radially away from the axis of rotation delimited by a second edge, the wall and the second edge having in at least a major part of the first angular interval in a radial plane perpendicular to the axis of rotation an inclination relative to the radial direction of at least 60° said second edge constituting a weir edge when said outlet opening is uncovered.

8. A decanter centrifuge according to claim 7, wherein said second angular interval is at least 45°.

9. A decanter centrifuge according to claim 7, wherein said second angular interval is at least 60°.

10. A decanter centrifuge according to claim 7, wherein said wall has in a radial plane perpendicular to the axis of rotation an inclination relative to the radial direction of at least 70°.

11. A decanter centrifuge according to claim 7, wherein said wall has in a radial plane perpendicular to the axis of rotation an inclination relative to the radial direction of at least 75°.

12. A decanter centrifuge according to claim 7, wherein the wall and the second edge has in at least a major part of the first angular interval in a radial plane perpendicular to the axis of rotation an inclination relative to the radial direction of at least 70°.

13. A decanter centrifuge according to claim 7, wherein the wall and the second edge has in at least a major part of the first angular interval in a radial plane perpendicular to the axis of rotation an inclination relative to the radial direction of at least 75°.

14. A decanter centrifuge according to claim 1, wherein said outlet opening is delimited by a circumferential edge comprising three parts, a first part constituting the second edge and having relative to the axis of rotation a proximal end and a distal end, a second part extending from the distal end of the first part towards the axis of rotation and a third part connecting the first part and the second part, wherein said slide valve body comprises an opening delimited by a circumferential edge comprising three sections, a first section extending in a direction, which with respect to a circumferential direction comprises an inclination of less than 30° said first section having relative to the axis of rotation a proximal end and a distal end, a second section extending from the distal end of the first edge towards the axis of rotation and a third section connecting the first section and the second section, and wherein said slide valve body is provided for rotation around the axis of rotation.

15. A decanter centrifuge according to claim 14, wherein the first section extends in a direction, which with respect to a circumferential direction comprises an inclination of less than 20°.

16. A decanter centrifuge according to claim 14, wherein the first section extends in a direction, which with respect to a circumferential direction comprises an inclination of less than 15°.

17. A decanter centrifuge according to claim 1, wherein the decanter centrifuge comprises a stop means adapted for delimiting the rotation around the axis of rotation of said slide valve body.

18. A decanter centrifuge according to claim 1, wherein said base plate comprises a plurality of, preferably three, outlet openings, and said slide valve body comprises a plurality of, preferably three, corresponding openings.

19. A decanter centrifuge according to claim 1, wherein said slide valve body is a one piece body.

20. A decanter centrifuge according to claim 1, wherein said second edge has in at least a major part of the first angular interval in a radial plane perpendicular to the axis of rotation an inclination relative to the radial direction of at least 70°.

21. A decanter centrifuge according to claim 1, wherein said second edge has in at least a major part of the first angular interval in a radial plane perpendicular to the axis of rotation an inclination relative to the radial direction of at least 75°.

* * * * *